US010588365B2

(12) United States Patent
Miktuk

(10) Patent No.: US 10,588,365 B2
(45) Date of Patent: Mar. 17, 2020

(54) HEM INSERT FOR FORMING A CUFF IN A GARMENT, GARMENT COMPRISING A HEM INSERT, AND METHOD OF FORMING A CUFF IN A GARMENT

(71) Applicant: Marcia Weinbach Miktuk, Rock Hill, SC (US)

(72) Inventor: Marcia Weinbach Miktuk, Rock Hill, SC (US)

( * ) Notice: Subject to any disclaimer, the term of this patent is extended or adjusted under 35 U.S.C. 154(b) by 248 days.

(21) Appl. No.: 15/723,791

(22) Filed: Oct. 3, 2017

(65) Prior Publication Data

US 2018/0020754 A1 Jan. 25, 2018

Related U.S. Application Data

(63) Continuation of application No. 14/407,712, filed as application No. PCT/US2013/070544 on Nov. 18, 2013, now Pat. No. 9,775,393.

(60) Provisional application No. 61/735,539, filed on Dec. 10, 2012.

(51) Int. Cl.

| | |
|---|---|
| ***A41D 27/00*** | (2006.01) |
| ***A41D 27/24*** | (2006.01) |
| ***A41D 27/06*** | (2006.01) |
| ***A41B 7/08*** | (2006.01) |
| *A41F 19/00* | (2006.01) |
| *A41D 1/06* | (2006.01) |
| *A41D 15/00* | (2006.01) |

(52) U.S. Cl.

CPC ..... *A41D 27/24* (2013.01); *A41B 7/08* (2013.01); *A41D 27/06* (2013.01); *A41D 1/06* (2013.01); *A41D 15/002* (2013.01); *A41D 2300/20* (2013.01); *A41F 19/005* (2013.01)

(58) Field of Classification Search

CPC ..... A41H 33/00; A41B 2300/24

See application file for complete search history.

(56) References Cited

U.S. PATENT DOCUMENTS

| | | | | | |
|---|---|---|---|---|---|
| 671,191 | A | * | 4/1901 | Hanauer | A41D 1/06 2/232 |
| 898,200 | A | * | 9/1908 | Elzas | A41D 1/06 2/232 |
| 2,301,047 | A | * | 11/1942 | Hendley | A41D 27/06 160/330 |
| 2,483,952 | A | | 10/1949 | Nayworth | |
| 2,524,814 | A | * | 10/1950 | Leaf | A41D 1/06 2/232 |
| 2,856,609 | A | * | 10/1958 | Persico | A41D 1/06 2/232 |
| 3,097,364 | A | | 7/1963 | Hess | |
| 3,155,986 | A | | 11/1964 | Miller | |
| 3,166,765 | A | * | 1/1965 | Getchell | A41D 1/06 2/227 |
| 3,170,167 | A | | 2/1965 | Manly | |
| 3,177,498 | A | * | 4/1965 | Sadowski | A41D 1/10 2/232 |

(Continued)

*Primary Examiner* — Khaled Annis

(74) *Attorney, Agent, or Firm* — Schwartz Law Firm, P.C.

(57) ABSTRACT

A hem insert is adapted for forming an inwardly or outwardly-turned cuff in a garment. The hem insert comprises an elongated flexible strip having opposing ends and opposing longitudinal straight edges. The hem insert is adapted for insertion into a sewn circumferential hem of the garment, and the hem subsequently folded by a wearer to form the cuff.

10 Claims, 10 Drawing Sheets

(56) References Cited

U.S. PATENT DOCUMENTS

| | | | | | |
|---|---|---|---|---|---|
| 3,328,809 | A | | 7/1967 | Rosemary | |
| 3,435,463 | A | * | 4/1969 | Aubrey | A41D 27/24 2/269 |
| 3,601,817 | A | | 8/1971 | Abrams | |
| 4,007,835 | A | * | 2/1977 | Klothe | A41D 27/06 206/411 |
| 4,602,389 | A | | 7/1986 | Brown | |
| 4,688,271 | A | | 8/1987 | Capelle | |
| 4,985,936 | A | * | 1/1991 | Jones | A41D 1/06 2/269 |
| 5,006,393 | A | * | 4/1991 | Isoe | A41D 27/245 156/60 |
| 5,535,453 | A | * | 7/1996 | Howard | A41D 1/06 2/227 |
| 5,539,932 | A | * | 7/1996 | Howard | A41D 1/06 2/227 |
| 2007/0083969 | A1 | * | 4/2007 | Brusilovsky | A41D 15/002 2/69 |
| 2008/0127397 | A1 | | 6/2008 | Toyne | |
| 2010/0088801 | A1 | | 4/2010 | Spiros | |

* cited by examiner

HEM INSERT FOR FORMING A CUFF IN A GARMENT, GARMENT COMPRISING A HEM INSERT, AND METHOD OF FORMING A CUFF IN A GARMENT

TECHNICAL FIELD AND BACKGROUND OF THE INVENTION

This invention relates broadly and generally to a hem insert for forming a cuff in a garment, garment comprising a hem insert, and method of forming a cuff in a garment. In exemplary embodiments, the present invention allows a user to quickly and easily change the length of a pants leg or other garment part, and to maintain the desired length without sewing or use of tape or other fasteners. The invention is removably or permanently held in the garment, and can remain in the garment during laundering. In alternative applications, the present invention may be used in other fabrics such as draperies, linens, upholstery, and the like.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure relates to a hem insert adapted for forming a cuff in a garment. The hem insert comprises an elongated flexible strip having opposing ends and opposing longitudinal straight edges. The hem insert is adapted for insertion into a sewn circumferential hem of the garment, and the hem subsequently folded by a wearer to form the cuff.

The term "cuff" refers broadly herein to any turned-up (or out) or turned-in portion of a garment. The cuff may be formed at any hemmed location including a pants leg, arm sleeve (short or long sleeve), pant waist, skirt or dress hem, neckline, waistline, midriff of a top, or the like. Once the cuff is formed, the cuff may be sewn by the wearer or left unattached (not sewn).

According to another exemplary embodiment, the flexible strip is fabricated of a material selected from a group consisting of woven or nonwoven materials, plastic, nylon, neoprene, vinyl, or other composite material. The opposite major surfaces of the flexible strip may be substantially planar, solid, and continuous.

According to another exemplary embodiment, the opposing longitudinal straight edges of the flexible strip are substantially parallel.

According to another exemplary embodiment, the flexible strip has a length dimension and a width dimension. The length dimension is at least 5 times greater than the width dimension.

According to another exemplary embodiment, the flexible strip defines a plurality of longitudinally spaced perforations (e.g., round or square-shaped cutouts).

According to another exemplary embodiment, at least one end of the flexible strip is rounded (e.g., having radiused corners) to facilitate insertion into the hem of the garment.

According to another exemplary embodiment, at least one end of the flexible strip is tapered.

According to another exemplary embodiment, at least one major surface of the flexible strip comprises a textured nonslip coating. Alternatively, the hem insert may comprise a resin-impregnated material with inherent slip-resistance.

In another exemplary embodiment, the present disclosure comprises a garment with at least one sewn circumferential hem, and a hem insert adapted for forming a cuff in the garment. The hem insert comprises an elongated flexible strip having opposing ends and opposing longitudinal straight edges. The hem insert is freely positioned into the sewn hem of the garment and unattached to the fabric of said garment, and the hem subsequently folded by a wearer to form the cuff (and adjust the length of the garment).

In yet another exemplary embodiment, the present disclosure comprises a method of forming a cuff in a garment. The method including forming an opening in a sewn circumferential hem in the garment, and inserting an elongated flexible strip through the formed opening in the circumferential hem. The circumferential hem is then folded, such that the flexible strip creates a generally stiff and stabilized shaped cuff.

According to another exemplary embodiment, the step of folding the circumferential hem comprises turning the garment inwardly at the hem to form an inwardly-turned cuff.

According to another exemplary embodiment, the step of folding the circumferential hem comprises turning the garment outwardly at the hem to form an outwardly-turned cuff.

According to another exemplary embodiment, the method includes positioning the flexible strip in the circumferential hem of a pants leg, such that opposing ends of the flexible strip are closely spaced-apart at a vertical front crease of the pants leg.

According to another exemplary embodiment, the method includes folding the circumferential hem and inserted flexible strip multiple times to shorten a length of the garment.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
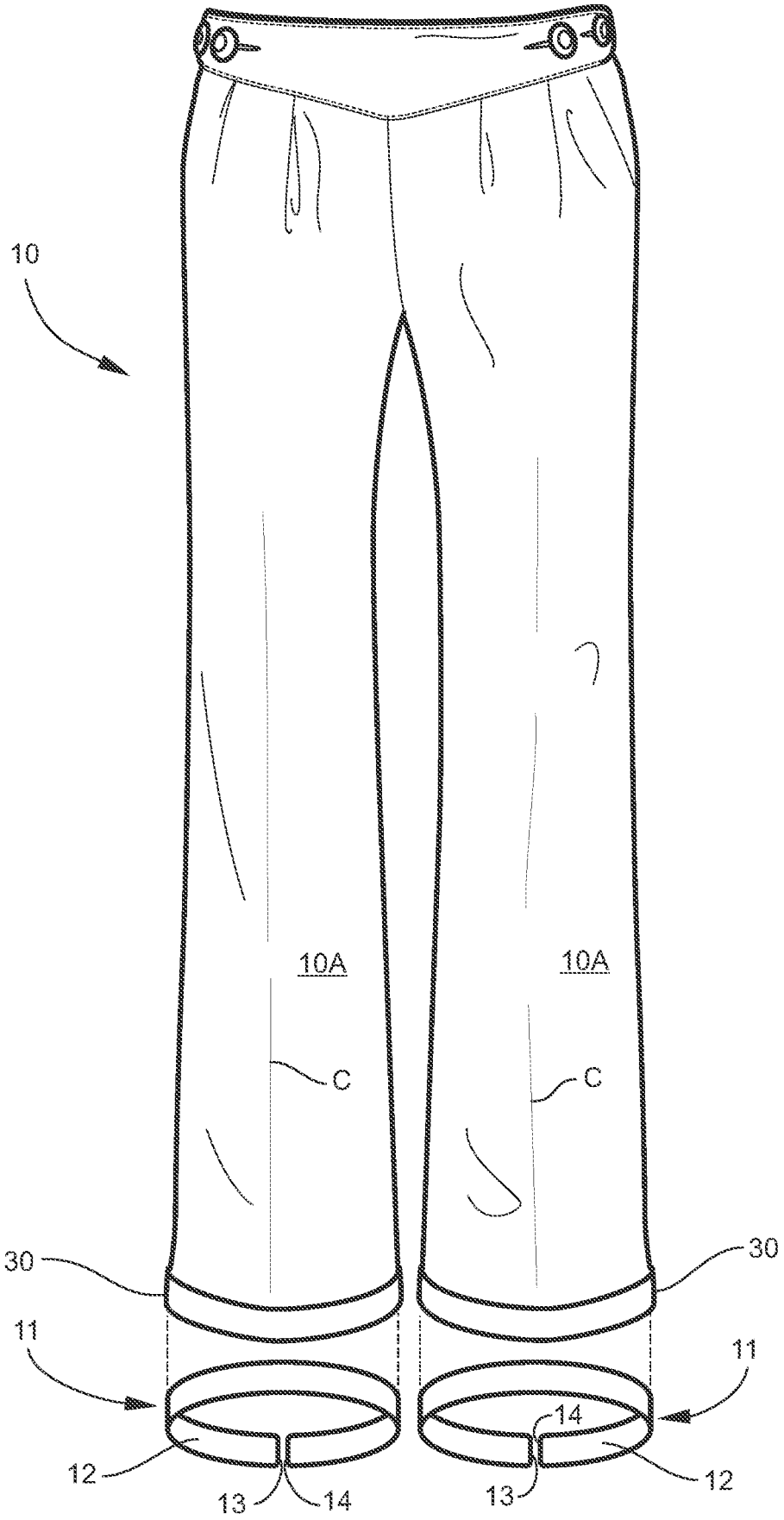
FIG. 1 is a view of an exemplary garment incorporating the present flexible hem inserts in respective pants legs.
Figure 2:
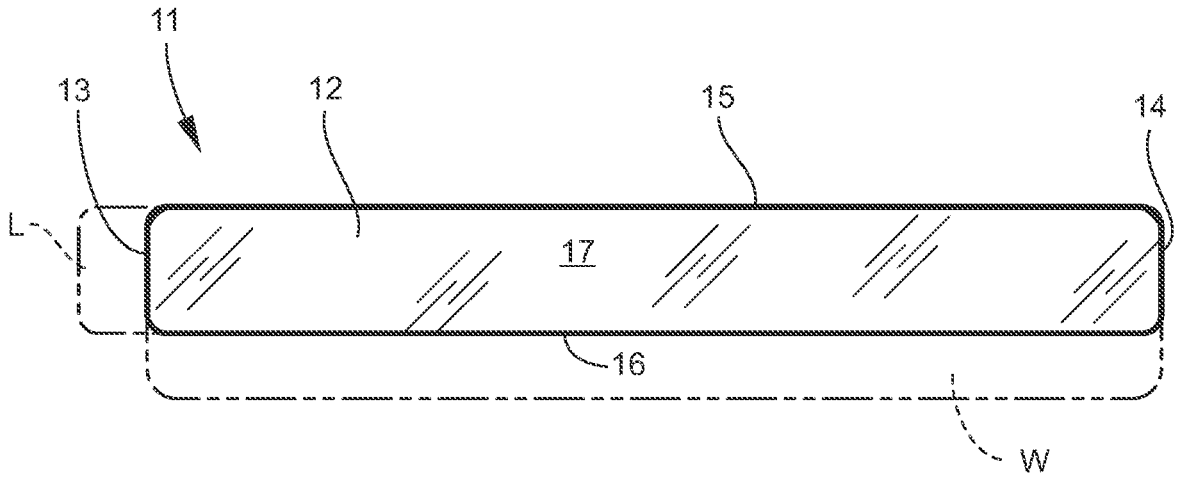
FIG. 2 is a view of the exemplary flexible hem insert with phantom lines representing an ability to readily modify length and width to custom fit a particular garment application.

Referring now specifically to the drawings, an exemplary garment incorporating hem inserts according to one embodiment of the present disclosure is illustrated in FIG. 1, and shown at broad reference numeral 10. The exemplary hem inserts are referenced at 11, and may be incorporated in both pants legs as described below to form respective inwardly-turned or outwardly-turned cuffs in the garment 10. As best shown in FIG. 2, each hem insert 11 comprises an elongated flexible strip 12 having opposing rounded ends 13, 14, opposing substantially straight (and parallel) longitudinal edges 15, 16, and opposing major surfaces 17 (only one shown). The hem insert 11 may be fabricated in a single dimension, and the flexible strip 12 custom-formed by the user to cut and remove any excess length "L" and/or width "W". Trim lines, measurement indicia, or other markings (not shown) may be provided on one or both major surfaces 17 of the flexible strip 12 to guide and facilitate cutting. In one example, the length of the flexible strip 12 (and hem insert 11) is substantially greater than its width—e.g, 3-10 times greater or more depending on the particular garment application.

The relative thickness of the flexible strip 12 may vary depending upon the fabric weight of the particular garment. For example, a thinner more flexible strip 12 might be used for lighter weight fabrics, while a thicker flexible strip 12 would be used for heavier fabrics. The general range of material thickness in the exemplary hem insert 11 is between about 0.0625 and 0.125 inches. The present hem insert 11 may be made of any suitable material, such as woven or nonwoven fabrics, plastic, nylon, neoprene, vinyl, or other composite material, having substantially flexibility in its length dimension and substantial rigidity in its width dimension.

In one embodiment of hem insert 11, one major surface 17 of the flexible strip 12 is substantially textured or resin-impregnated to limit any shifting of the insert 11 during wear and laundering of the garment 10, while the opposite major surface of strip 12 remains substantially smooth to facilitate incorporation of the insert 11 into the garment hem, as described below. In alternative embodiments, the hem insert 11 may be inserted into or formed with the hem of the garment 10 at the time of manufacture.

Figure 3:
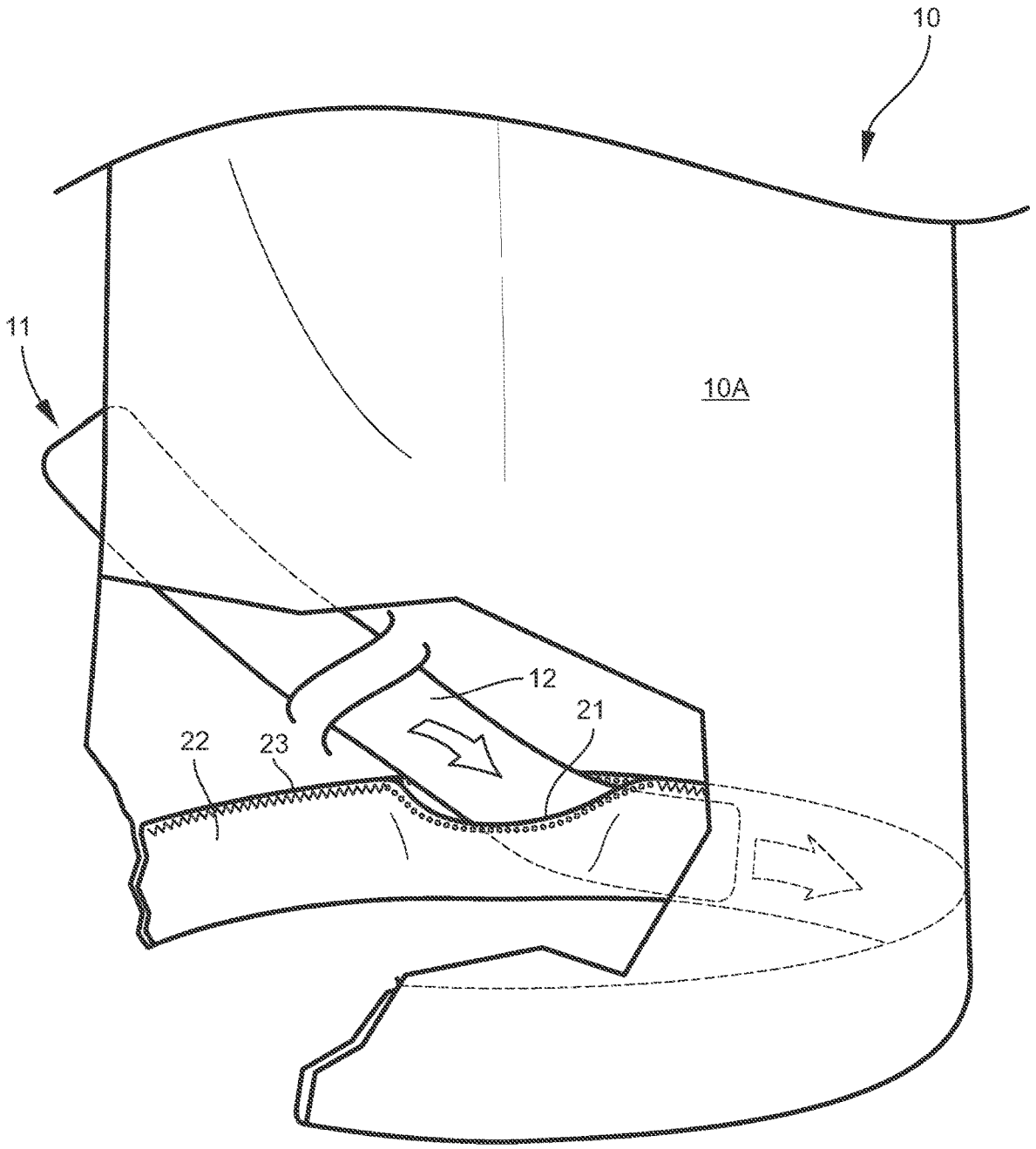
FIGS. 3, 4, and 5 are sequential views demonstrating application of the flexible hem insert into an existing sewn hem of the garment.
Figure 4:
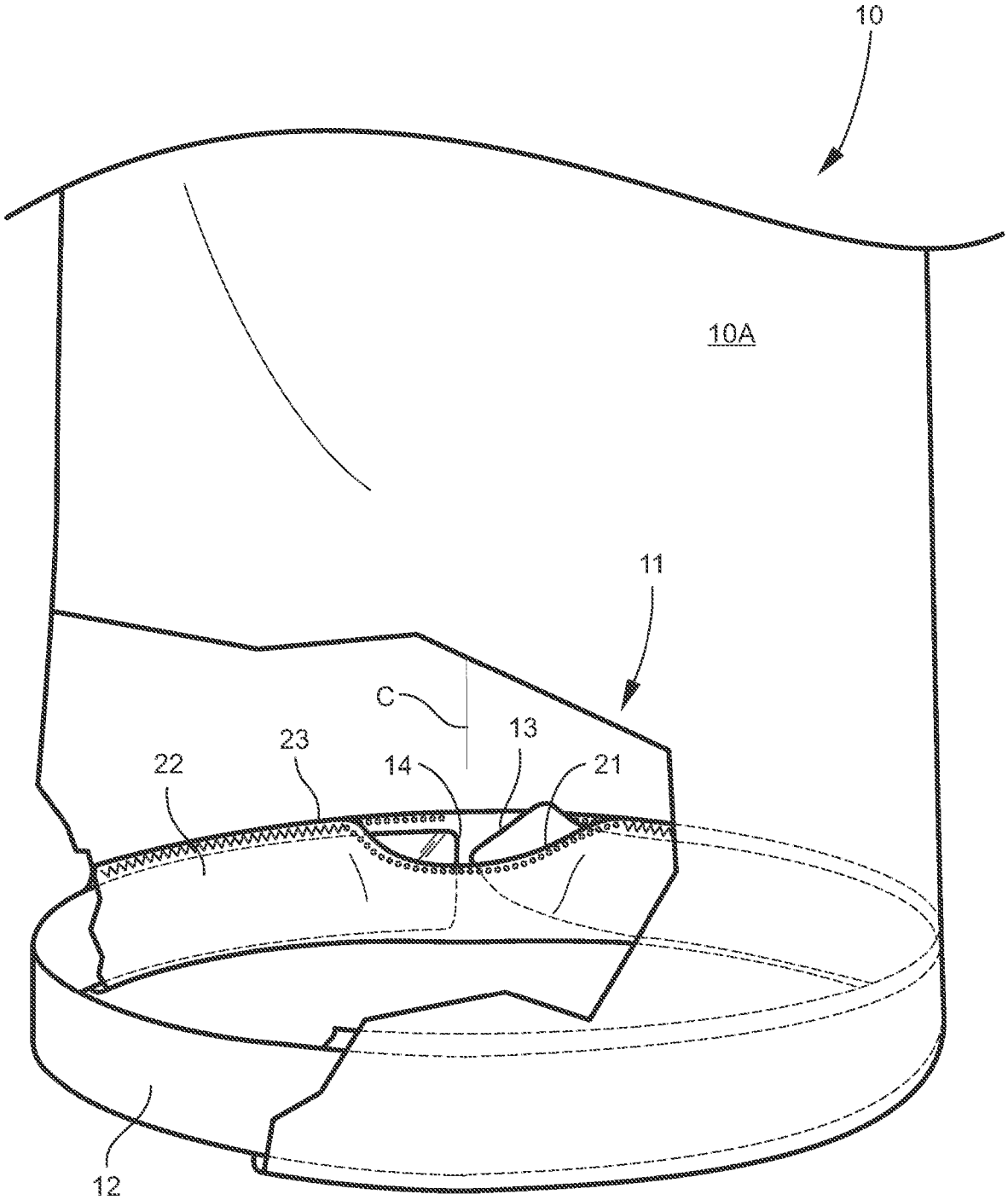
Figure 5:
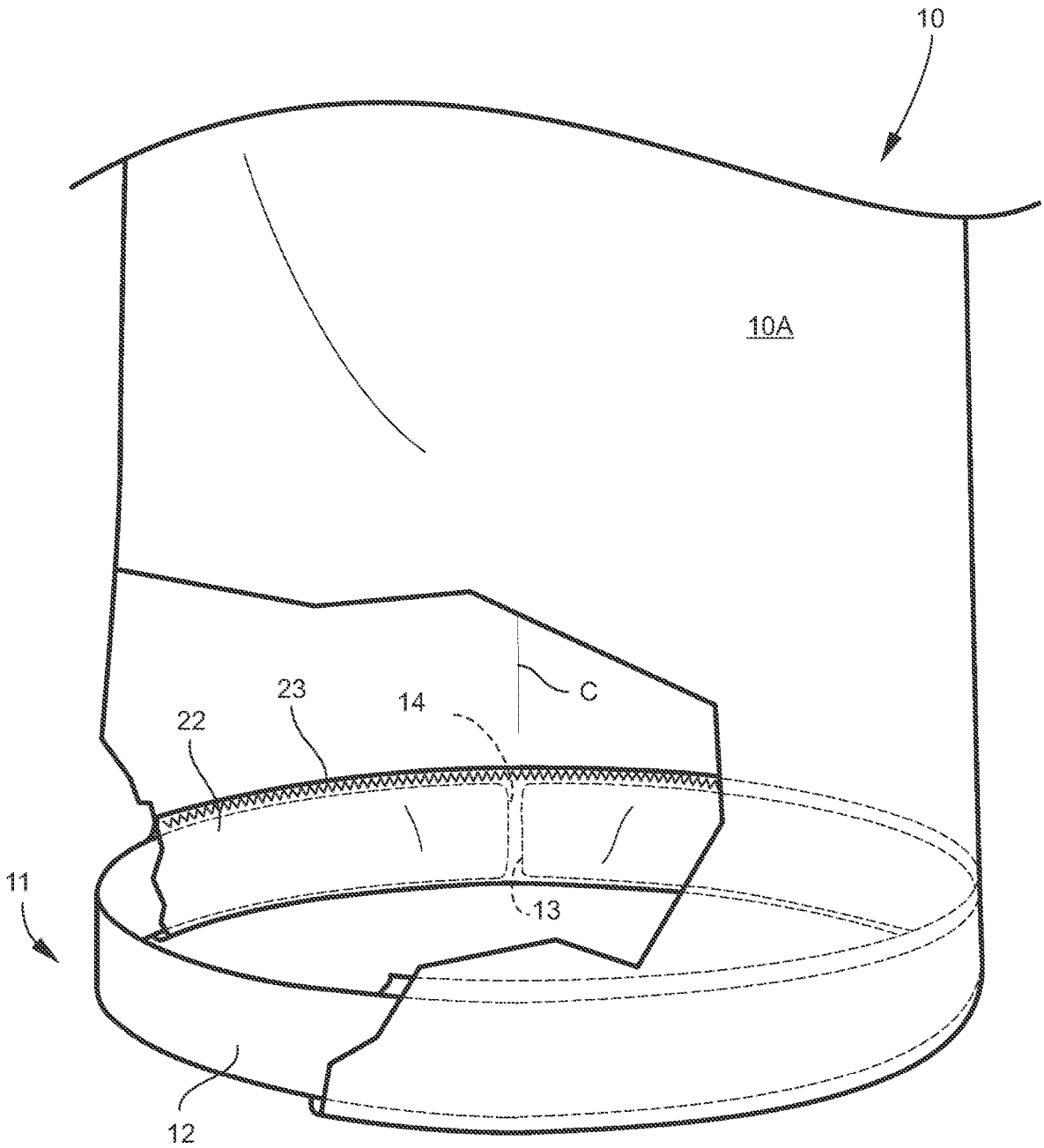

FIGS. 3, 4, and 5, demonstrate a process for retrofitting the garment 10 with hem insert 11 in each pants leg 10A. The hem insert 11 is first measured and cut, as previously described, to precisely match the particular garment application. A relatively small slit 21 is made in the existing circumferential pants hem 22 by cutting the thread along a sewn inside top edge 23. The slit 21 is then opened forming a pocket to receive the flexible hem insert 11, as shown in FIGS. 3 and 4. The hem insert 11 is fed through the hem 22 and arranged circumferentially such that opposite ends 13, 14 of the flexible strip 12 are closely spaced apart at the front vertical crease "C" of the pants leg 10A (See also FIG. 1). The hem slit 21 may then be re-sewn as shown in FIG. 5 or left open, as desired. In other implementations not shown, the two or more exemplary hem inserts 11 may be used in a single pants leg 10A.

Figure 6A:
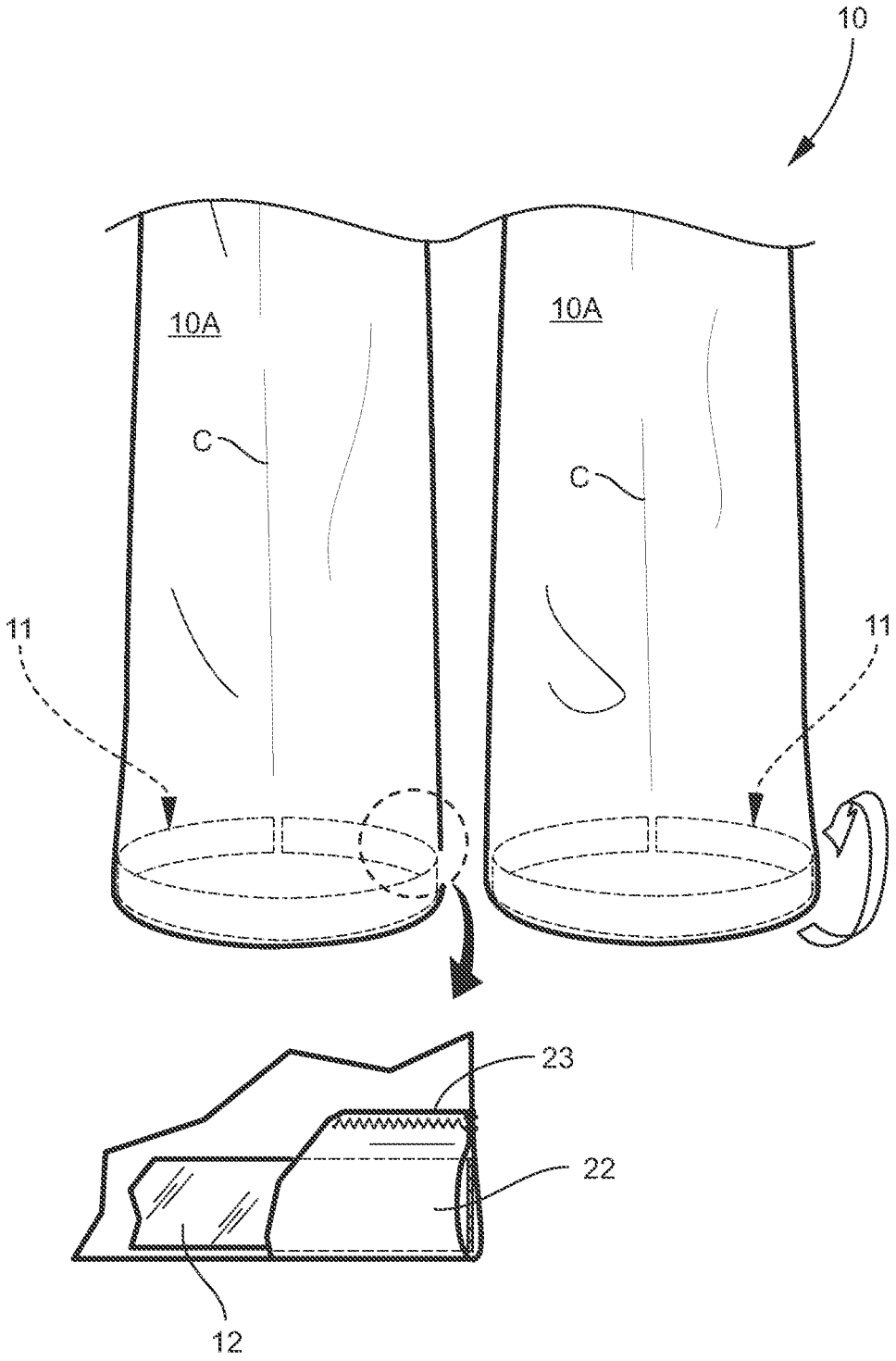
FIGS. 6A and 6B are views demonstrating an exemplary technique for forming an outside cuff in the garment to shorten its length.
Figure 6B:
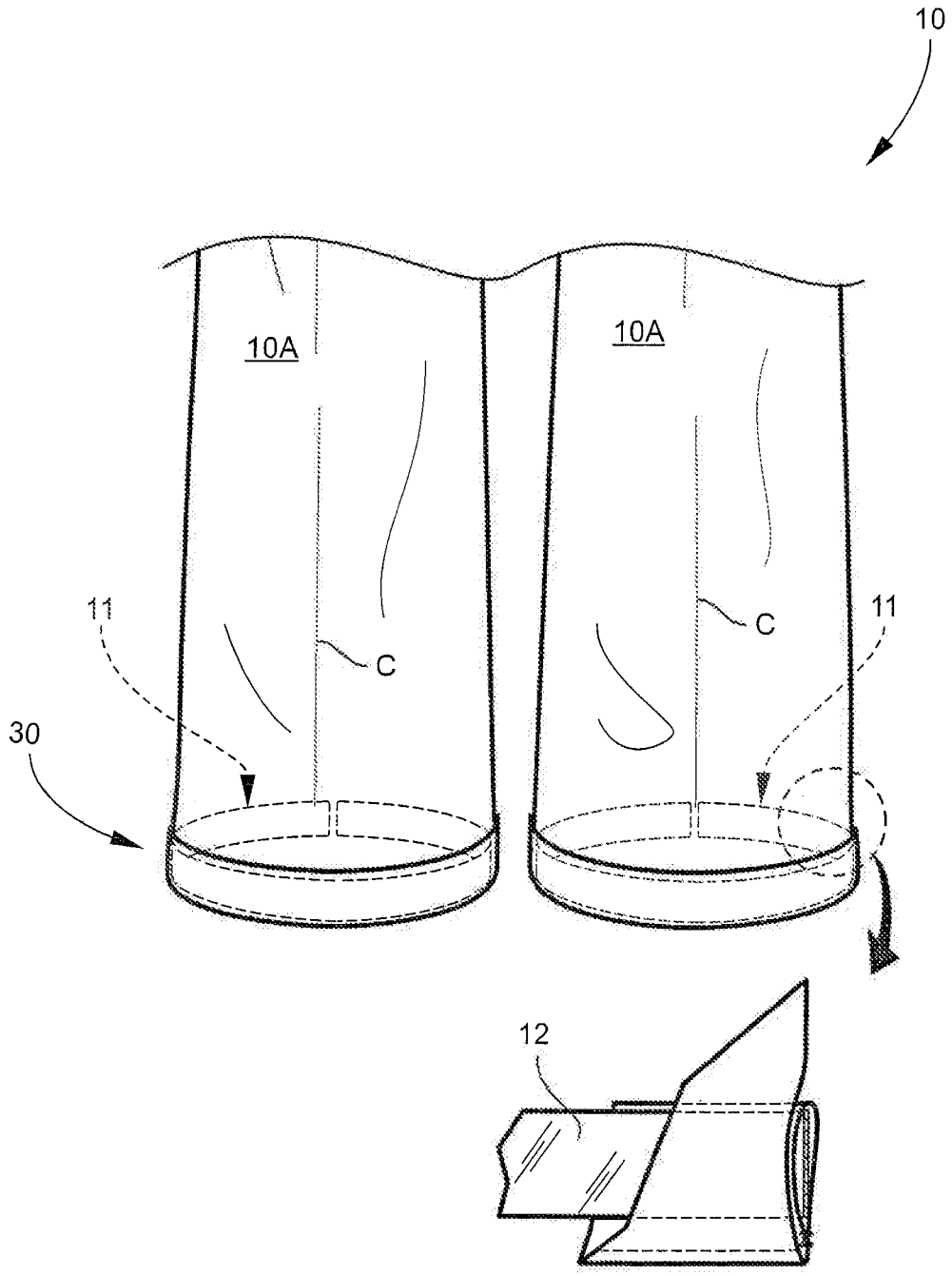
Figure 7A:
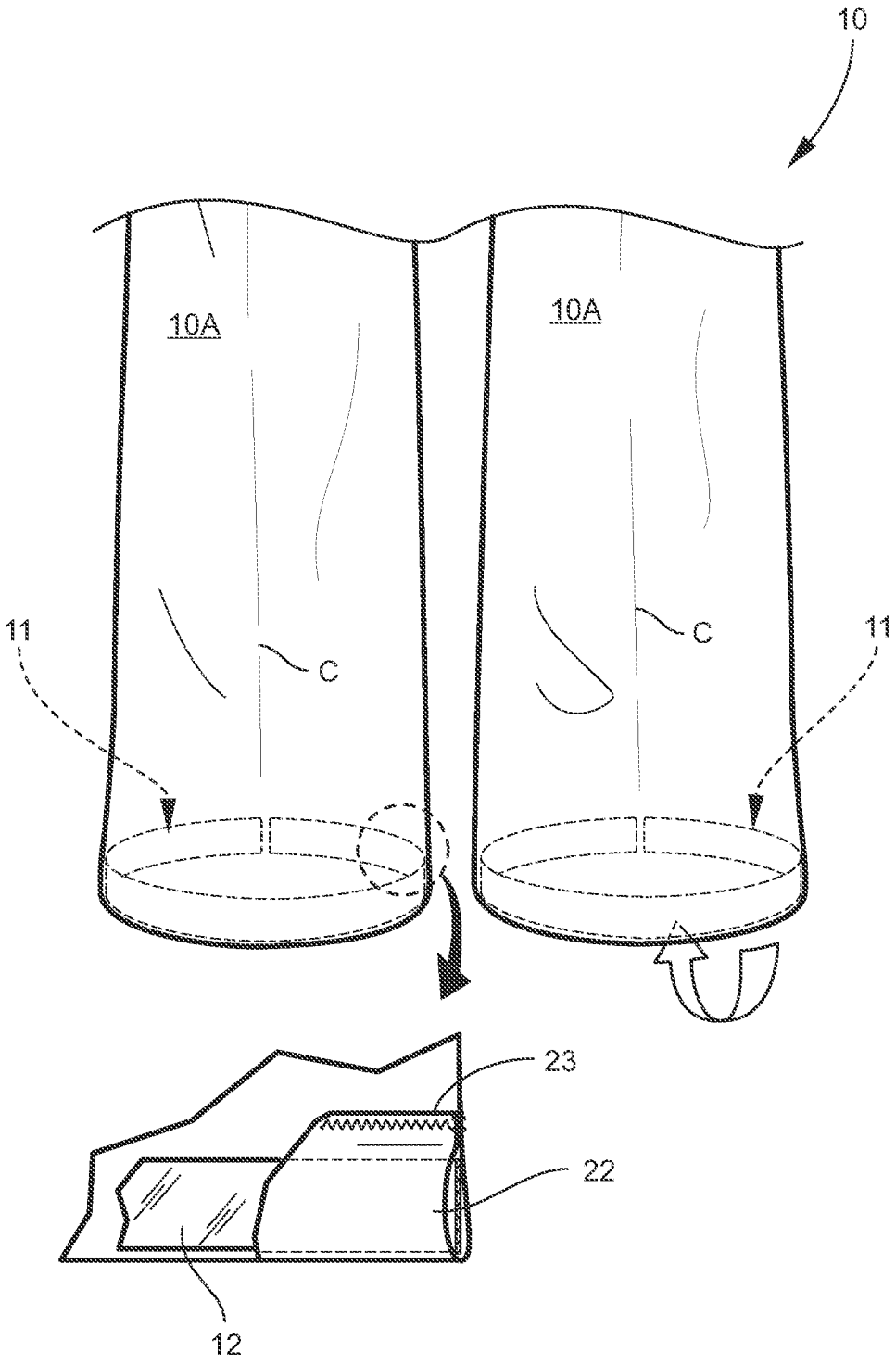
FIGS. 7A and 7B are views demonstrating an exemplary technique for forming an inside cuff in the garment to shorten its length.
Figure 7B:
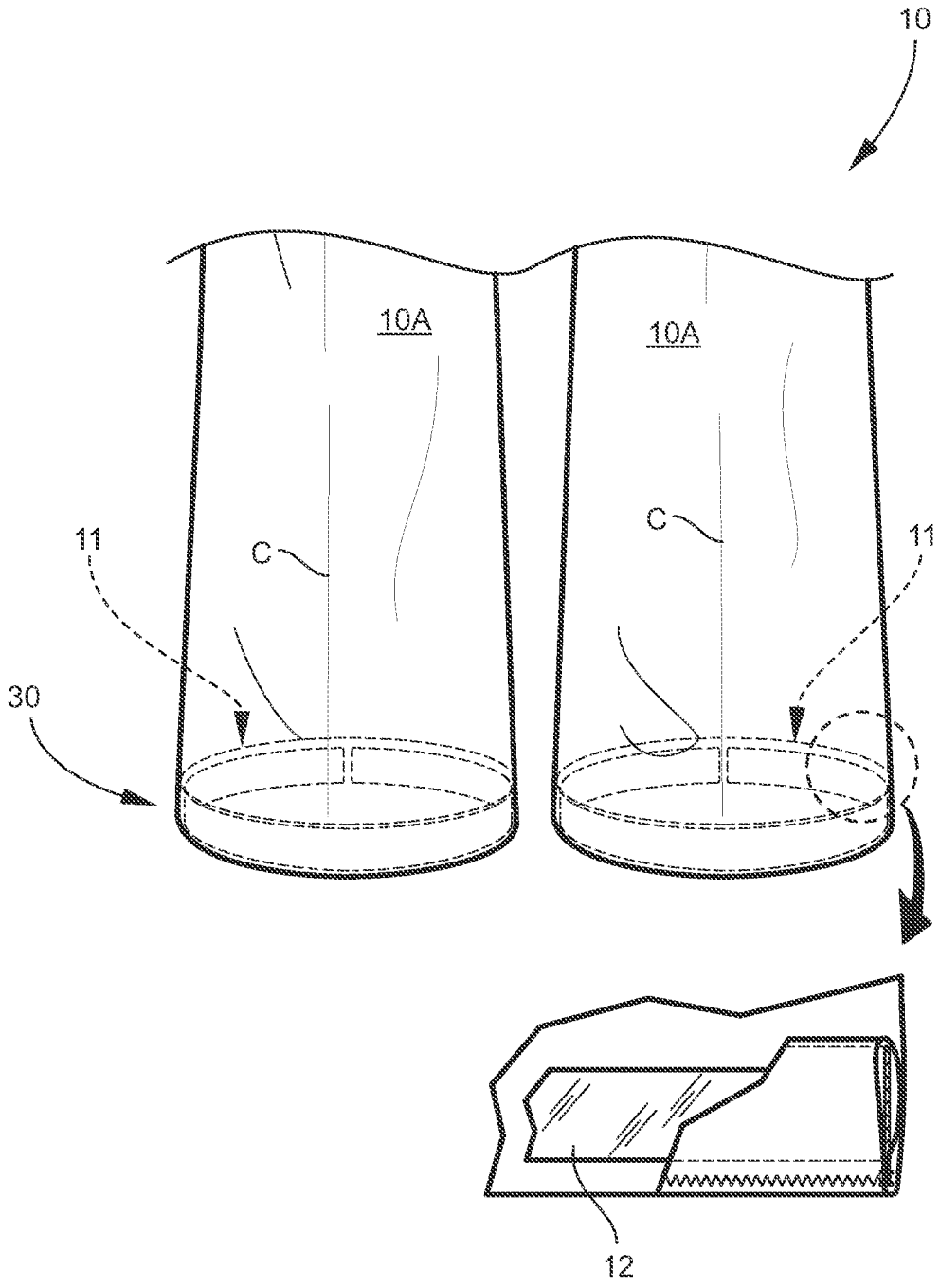

Once the hem inserts 11 are incorporated in the garment 10, each pants leg 10A may be turned up one or more times at the hem 22, as demonstrated in FIGS. 6A and 6B, to shorten the length of the leg and form a generally stiff and stabilized, shaped cuff 30 (See also FIG. 1). Alternatively, the garment length may be shortened and the cuff 30 formed by turning or folding the pants leg inwardly at the hem 22, as demonstrated in FIGS. 7A and 7B.

Figure 8:
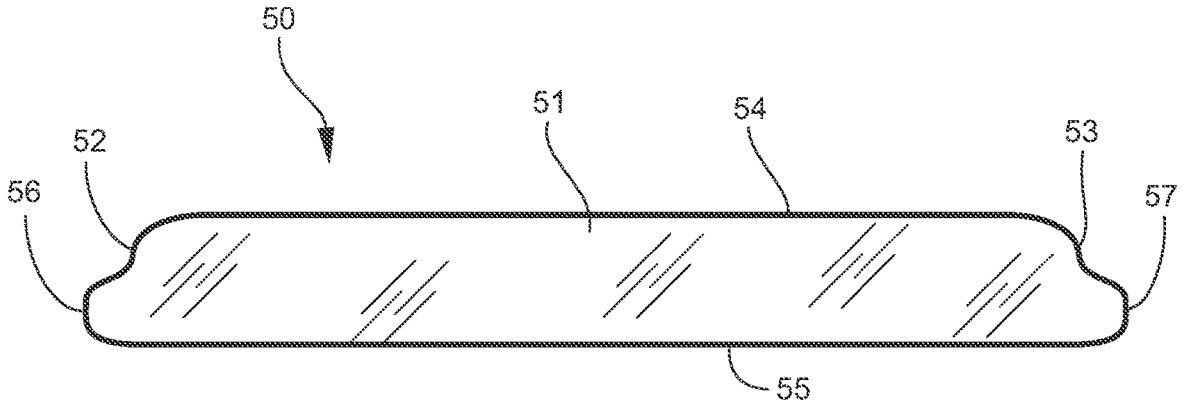
FIGS. 8 and 9 are views illustrating alternative embodiments of the present flexible hem insert.
Figure 9:
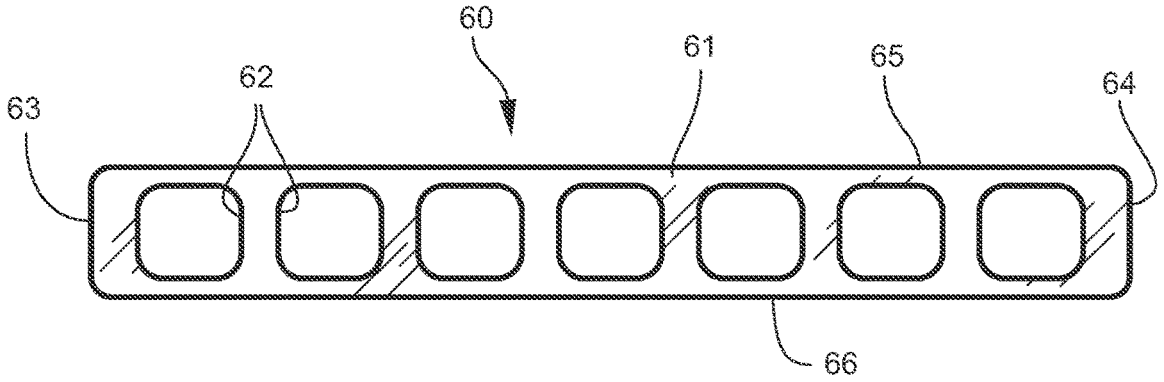

Additional exemplary embodiments of the present hem insert are illustrated in FIGS. 8 and 9. In FIG. 8, the exemplary hem insert 50 comprises an elongated flexible strip 51 having opposing ends 52, 53 and opposing substantially straight longitudinal edges 54, 55. The ends 52, 53 in this embodiment are substantially tapered and rounded at respective points 56, 57. In FIG. 9, the exemplary hem insert

60 comprises an elongated flexible strip 61 with a series of spaced-apart cutouts (or perforations) 62, opposing rounded ends 63, 64, and opposing substantially straight longitudinal edges 65, 66. Both alternative embodiments 50, 60 may be used in an identical manner described above with reference to hem insert 11. The exemplary hem inserts may also be fabricated of a longitudinally flexible and laterally stiff mesh fabric, polymer-coated mesh wire, or other such material.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed:

1. An adjustable length pants constructed of a fabric and comprising a pair of pants legs having respective circumferential hems, said pants further comprising:

first and second hem inserts freely positioned within respective hems of said pants legs and unattached to the fabric of said pants, and each hem insert comprising an elongated flexible strip having opposing ends defining therebetween a length of said flexible strip, and opposing longitudinal edges defining therebetween a width of said flexible strip, and the length of said flexible strip being sufficient to extend said hem insert circumferentially within said hem, and wherein at least one of said opposing ends of each flexible strip is rounded to facilitate insertion of said hem inserts into respective hems of said pants legs;

a circumferentially reinforced cuff adapted for being formed at the hem of each pants leg by turning said hem insert upwardly, such that a width of said cuff corresponds substantially to the width of said flexible strip, thereby shortening said pants leg by each upward turn of said hem insert, and returning said pants leg to its original length by a corresponding downward turn of said hem insert, and wherein said hem insert flexes outwardly within said hem to promote and retain the circumferential shape of said cuff.

2. The adjustable length pants according to claim 1, wherein said flexible strip is fabricated of a material selected from a group consisting of woven and nonwoven fabrics.

3. The adjustable length pants according to claim 1, wherein said flexible strip is fabricated of a material selected from a group consisting of plastic, nylon, neoprene, and vinyl.

4. The adjustable length pants according to claim 1, wherein the opposing longitudinal edges of said flexible strip are substantially parallel.

5. The adjustable length pants according to claim 1, wherein the length of said flexible strip is at least 5 times greater than the width of said flexible strip.

6. The adjustable length pants according to claim 1, wherein at least one end of said flexible strip is rounded to facilitate insertion into the hem of the pants leg.

7. The adjustable length pants according to claim 1, wherein at least one end of said flexible strip is tapered.

8. The adjustable length pants according to claim 1, wherein at least one major surface of said flexible strip comprises a coating.

9. The adjustable length pants according to claim 1, wherein said cuff is formed in said pants leg by turning said hem insert inwardly at the hem.

10. The adjustable length pants according to claim 1, wherein said cuff is formed in said pants leg by turning said hem insert outwardly at the hem.

* * * * *